US011564464B2

(12) United States Patent
Senia

(10) Patent No.: US 11,564,464 B2
(45) Date of Patent: Jan. 31, 2023

(54) MODULAR EARRING ASSEMBLY

(71) Applicant: Christina Senia, Morganville, NJ (US)

(72) Inventor: Christina Senia, Morganville, NJ (US)

( * ) Notice: Subject to any disclaimer, the term of this patent is extended or adjusted under 35 U.S.C. 154(b) by 114 days.

(21) Appl. No.: 17/021,371

(22) Filed: Sep. 15, 2020

(65) Prior Publication Data

US 2022/0079304 A1 Mar. 17, 2022

(51) Int. Cl.
*A44C 7/00* (2006.01)

(52) U.S. Cl.
CPC ..... *A44C 7/002* (2013.01)

(58) Field of Classification Search
CPC ..... A44C 7/00; A44C 7/002; A44C 7/003; A44C 7/001; A44C 13/00
USPC ..... 63/40
See application file for complete search history.

(56) References Cited

U.S. PATENT DOCUMENTS 5,161,390 A * 11/1992 Sam ..... A44C 7/00 63/12
2009/0282867 A1* 11/2009 Monahan ..... A44C 15/005 63/40

FOREIGN PATENT DOCUMENTS

FR 3025073 A1 * 3/2016 ..... A44C 25/001
KR 20090011613 A * 5/2002 ..... A44C 7/002
KR 20020035278 A * 7/2007 ..... A44C 7/002
KR 200456842 Y1 * 12/2011 ..... A44C 7/002

* cited by examiner

*Primary Examiner* — Jack W Lavinder
(74) *Attorney, Agent, or Firm* — DLA Piper LLP (US)

(57) ABSTRACT

Disclosed is a modular earring assembly including two or more separate earring components that may be connected together in a variety of different ways to provide different earring presentations to the user or be separately used. The modular earring assembly allows a user to pick and match two or more earring components in the assembly to a desired presentation or to use any one component of the modular earring assembly alone. The modular earring assembly provides a way to manage the demand for multiple earring presentations. This disclosure allows woman and men to have more earring choices anywhere anytime.

12 Claims, 10 Drawing Sheets

MODULAR EARRING ASSEMBLY

FIELD OF INVENTION

This disclosure is directed to jewelry and more particularly to an earring assembly.

BACKGROUND

An earring is a piece of jewelry that may be attached to the ear. Earrings are worn by both sexes and have been used by different civilizations over the course of history.

Earrings may come in different types.

A stud earring is typically an earring that creates the appearance of floating on the ear or earlobe since the friction back or clutch typically holding the post of the stud to the ear is located behind the earlobe and so is not visible from the front. The stud earrings typically have a stud affixed to one end of a post which may be threaded through a piercing in the earlobe or another external part of the ear. The post may be held in place by a removable friction back or clutch. If the post is threaded, a screw back may be used to hold the earring in place securely. A screw back may be useful in preventing the loss of expensive earrings such as one containing precious stones or precious metals.

A hoop earring is typically an earring that may be circular or semi-circular in design and look very similar to a ring. Hoop earrings typically come in the form of a hoop of a material such as metal. The hoop may be formed in the shape of a closed letter "C" with the ends of the letter "C" adjoining each other to create the appearance of a ring. The adjoining ends of the ring may be opened up with each end being insertable into opposing sides of the ear piercing. In an alternative construction, a small piece of material or wire such as made from metal may be provided at either or both ends of the adjoining ends of the earring for insertion deeper into or through the ear piercing to provide a firmer attachment of the earring to the ear.

A dangle earring is typically an earring with a dangler or chain that when attached to the ear lobe appears to flow downward from the ear lobe. The length of the dangler or chain may typically be a centimeter or two or extend the full length to brush the shoulders. Dangle earrings may be provided with a hook at one end for passing through the piercing in the ear lobe to hold the dangle earring in place. In other examples, the dangle earring may be connected to an attachment hoop formed in the shape of a closed letter "C" with the ends of the letter "C" adjoining each other to create the appearance of a ring. Attachment may be by opening of the adjoining ends for inserting the ends into opposing sides of the ear piercing. The adjoining ends may be provided with a fastener mechanism that allows an earring to be easily put on and taken off without causing any damage. The fastener mechanism may be a small piece of material or wire moveably affixed at one end to one adjoining end of the ring and moveable at another end to allow the fastener mechanism to open so that the material or wire may be inserted deeper into or through the ear piercing and afterwards closed to provide for a firmer attachment. The fastener mechanism may include a small piece of material or wire moveably affixed on each of the adjoining ends of the ring, one or both being moveable to open and close so that the earring may be attached into or through the ear piercing and previously explained. The dangling earring may also be provided with a post for threading through a piercing in the earlobe or another external part of the ear; the post being held in place by a removable friction back or clutch or screw back as previously explained.

These and other conventional earrings are typically designed to be a one earring design for one particular use, For example, the stud earring is configured on one end with a post for attachment to the ear lobe and on the other end with a stud. While it may be possible for the post to be configured with a thread hole or other mechanism for attachment of a variety of different studs, the composite stud earring remains just that, a stud earring—to wit, a post with a stud. Simply put, the stud earring is one earring of one design.

Similarly, the hoop earring may be configured in the shape of an open letter "C" to allow adjoining ends to be used for attachment to the ear lobe while creating the appearance of a ring. As with a stud earring, the hoop earring is one earring of one design.

Similar too is the dangle earring. Where, for example, the dangler or chain of the dangle earring is attached to the ear lobe using a hook or post, as with a stud earring, the dangle earring is one earring of one design. Where, for example, the dangler or chain of the dangle earring is attached to the ear lobe using an attachment hoop, the dangler or chain may be removed from the attachment hoop. This allows the dangles or chains to be changed out to different designs for use with the attachment hoop. Still, the dangler earring on attachment hoop arrangement remains one earring of one design.

The conventional earrings that are based upon a one earing one design approach have stood the test of time over the course of history. In simpler times, where a woman or man had one event to attend during the day like going to work and another event to attend in the evening like a dinner engagement, it was easy for the woman or man to use one earring like a stud earring for work and another earring like a dangler for the dinner engagement. But today's world is not so simple. Women and men alike may find their days more and more filled with more events that may call for different attire and with different attire may come the need to use different earrings. Even where the daily routine involve few events, things may be different when there is travel involved since the collective travel days may call for more events which may call for different attire and with different attire may come the need to use different earrings.

With the conventional one earing one design approach to earrings, a woman or man may need to have an array of one earing one design earrings on hand in order to get through the events of a day or the events of several days if there is travel involved. This creates a demand to have more earring choices anywhere anytime. With this demand come additional problems like the need for women and men to expend considerable time and energy in making choices in advance on which earrings to take to work or bring on a trip and how to carry the earrings one may need to use with different apparel for different events during the day or for travel. Further, fast fashion continues to make a considerable, negative impact on the environment because more earrings are required per user. The implementation of modular earring styles according to this disclosure provide customization of user earring choices with a more environmentally sustainable footprint to addresses these problems.

SUMMARY

Disclosed is a modular earring assembly including two or more separate earring components that may be connected together in a variety of different ways to provide different earring presentations to the user or be separately used. The modular earring assembly allows a user to pick and match two or more earring components in the assembly to a desired presentation or to use any one component of the modular earring assembly alone. The modular earring assembly provides a way to manage the demand for multiple earring presentations. This disclosure allows woman and men to have more earring choices anywhere anytime.

In one aspect, the earring assembly includes a first earring and a second earring. The first earring includes a first hoop of predetermined diameter and having a predetermined thickness and defining a first opening. The second earring includes a second hoop of predetermined diameter and having a predetermined thickness and defining a second opening. The second hoop includes a securing mechanism for securing the second earing to an earlobe or another external part of the ear of the user. In an assembled configuration, the second earring is configured to be threaded through the opening of the first hoop and the piercing in the earlobe or another external part of the ear of a user. The securing mechanism is configured to be secured in order to hold the first earring and the second earring to the earlobe or another external part of the ear of the user. In other aspects, a third or more hoops may be included in the earring assembly. The earring assembly provides a set of earrings useable by the user. One or more earrings of the earring assembly may be utilized by the user to allow for a wide arrangement of earring uses for the user.

DETAILED DESCRIPTION

Figures 1A, 1B, 1C:
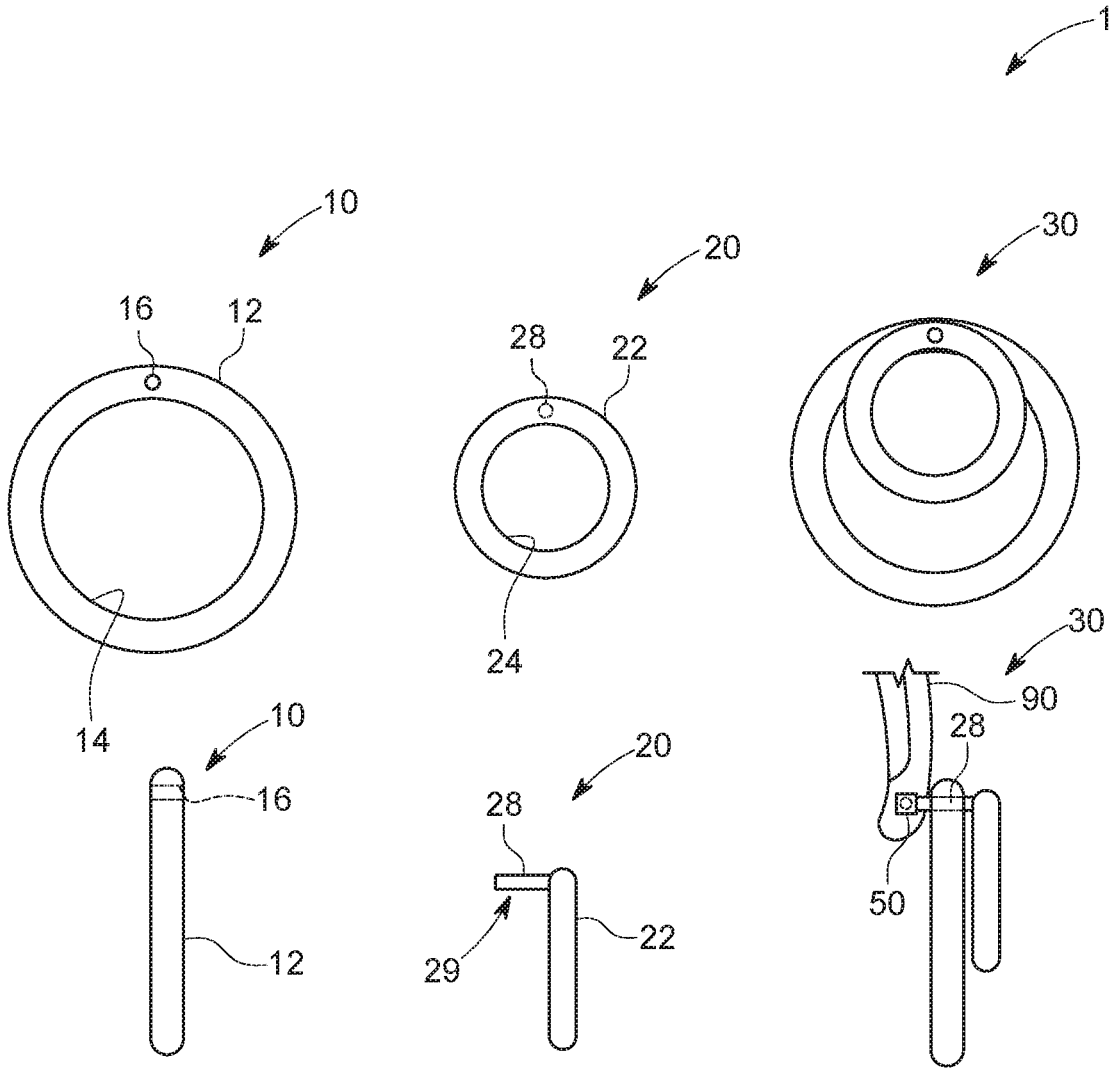
FIGS. 1A, 1B, 1C (collectively FIG. 1) discloses an illustrative earring assembly of this disclosure illustrating a first and a second assembled configuration for the illustrative earring assembly according to this disclosure.

In the following detailed description, reference is made to the accompanying drawings that form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Broadly speaking, disclosed is a modular earring assembly including two or more separate earring components that may be connected together in a variety of different ways to provide different earring presentations to the user or be separately used. The modular earring assembly allows a user to pick and match two or more earring components in the assembly to a desired presentation or to use any one component of the modular earring assembly alone. The modular earring assembly provides a way to manage the demand for multiple earring presentations. This disclosure allows woman and men to have more earring choices anywhere anytime.

Illustratively, an earring assembly includes a first earring and a second earring. The first earring includes a first hoop of predetermined diameter and having a predetermined thickness and defining a first opening. The second earring includes a second hoop of predetermined diameter and having a predetermined thickness and defining a second opening. The second hoop includes a securing mechanism for securing the second earing to an earlobe or another external part of the ear of the user. In an assembled configuration, the second earring is configured to be threaded through the opening of the first hoop and the piercing in the earlobe or another external part of the ear of a user. The securing mechanism is configured to be secured in order to hold the first earring and the second earring to the earlobe or another external part of the ear of the user.

FIG. 1 discloses an illustrative earring assembly 1 of this disclosure with the top row of figures depicting front views and the bottom row of figures depicting side views associated with those front views. The earring assembly 1 includes a first earring 10, a second earring 20, and a post holder 50. The first earring 10 includes a first hoop 12 of predetermined diameter and having a predetermined thickness and defining a first opening 14. The first hoop 10 defines a first channel 16 of a predetermined diameter through a portion of the side of the first hoop. The first channel 16 extends through the predetermined thickness of the first hoop 10.

The second earring 20 includes a second hoop 22 of predetermined diameter and having a predetermined thickness and defining a second opening 24. The second hoop 22 includes a first post 28 of a predetermined diameter and a length longer than the predetermined thickness of the first hoop 10. The first post 28 extends from and away from a portion of a side of the second hoop 22. The predetermined diameter of the first post 28 is smaller than the predetermined diameter of the first channel 16 of the first hoop. The first post 28 is configured to extend through the first channel 16 of the first hoop 12.

The first post holder 50 is configured for placement on the end of the first post 29.

In a first assembled configuration, the first post 28 of the second hoop 22 may be configured to be threaded through the first channel 16 of the first hoop 12 and a piercing in the earlobe or another external part of the ear of a user 90. The first post holder 50 may be configured to be placed on the end of the threaded first post 29 of the second hoop 22 in order to hold the first earring 10 and the second earring 20 to the earlobe 90 or another external part of the ear of the user.

FIG. 1B discloses a second assembled earring configuration for the earring assembly of FIG. 1. In the second assembled configuration of the earring assembly, the first post 28 of the second hoop 22 is configured to be threaded through a piercing in the earlobe (not shown) or another external part of the ear of a user but not through the first channel 16 of the first hoop 12. The first post holder 50 is configured to be placed on the end of the threaded first post 29 of the second hoop 20 in order to hold the second ring 20 to the earlobe or another external part of the ear of the user. The first ring 10 is not attached to the earlobe or another external part of the ear of the user in the second assembled configuration of the earring assembly of this disclosure.

In the earring assembly disclosed in FIG. 1, the predetermined diameter of the first hoop 10 may be larger than the predetermined diameter of the second hoop 20. Alternatively, the predetermined diameter of the first hoop 10 may be smaller than the predetermined diameter of the second hoop 20.

In the earring assembly disclosed in FIG. 1, the first post holder 50 may be a removable friction back. Alternatively, the first post holder may be a clasp. Removable friction back and clasps for use with earrings are well known in the art and a matter of design choice.

Figure 2A:
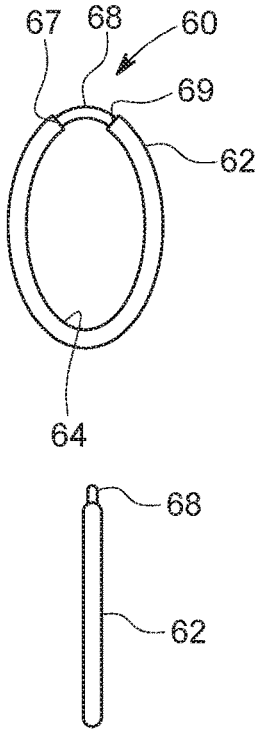
FIGS. 2A, 2B, 2C (collectively FIG. 2) discloses a third and fourth assembled configuration for an illustrative earring assembly according to this disclosure.
Figure 2B:
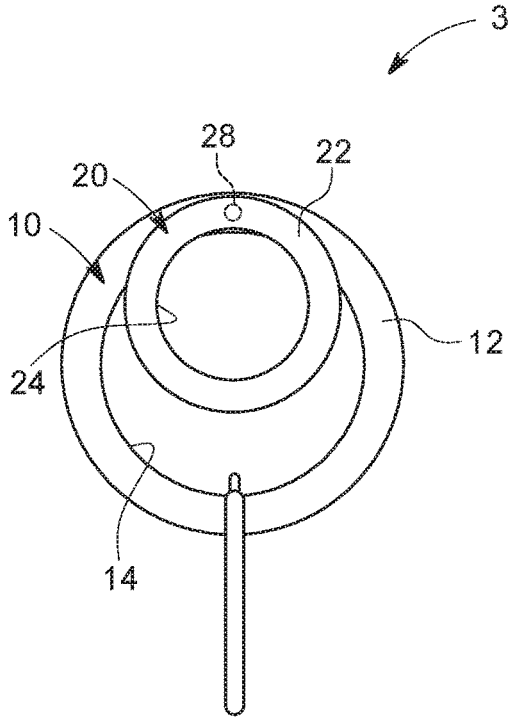
Figure 2C:
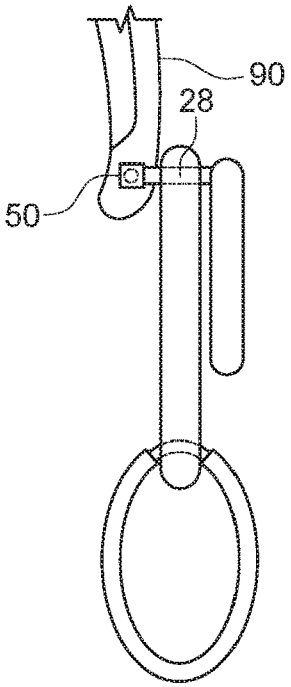

FIG. 2 discloses a third assembled configuration 3 for the illustrative earring assembly of FIG. 1. In FIG. 2, the top figure depicts a front view and the bottom figure depicts side view associated with the front view. The earring assembly includes a first earring 10, a second earring 20, and a post holder 50 which have a form and function as previously explained. The earring assembly of FIG. 2 further includes a third earring 60. The third earring 60 includes a third hoop 62 of predetermined diameter and having a predetermined thickness and defining a third opening 64. The third hoop 62 may be formed in the shape of a closed letter "C" with the ends 67, 69 of the closed letter "C" adjoining each other to create the appearance of a ring. As used throughout this disclosure, adjoining means that the ends 67, 69 may be next to or in close proximity to each other. For instance, in FIG. 2, a fastener mechanism 68 as explained below may be provided between closely proximated ends 67, 69. The adjoining ends 67, 69 of the third hoop 62 may be openable up with respect to each other when moved apart and may be closely positioned with respect to each other when in a normal position. Each adjoining end 67, 69 of the third hoop 60 may be configurable when moved apart for insertion into opposing sides of the piercing in the earlobe or another external part of the ear of a user.

In the third assembled configuration of the earring assembly of this disclosure, each adjoining end 67, 69 of the third hoop 62 may be configurable when moved apart for insertion through the opening 14 defined by the first hoop 12 and when allowed to return to the normal position to be closely positionable with respect to each other so as to attachably hold the third hoop 62 to the first hoop 12 when the first earring 10 and the second earring 20 are held to the earlobe 60 or another external part of the ear of the user by the placement of the first post 50 holder on the end of the first post 28 of the second hoop 20 after being threaded through the piercing in the earlobe or another external part of the ear of a user.

When being closely positioned following return to the normal position following insertion of the adjoining ends through the opening 14 defined by the first hoop 10, the adjoining ends 67, 69 hold the third ring 60 to the first ring 10. In this example, the fastener mechanism 68 provided between closely proximated ends 67, 69 coacts with adjoining ends 67, 69 in holding the third ring 60 to the first ring.

In the earring assembly disclosed in FIG. 2, the adjoining ends may be provided with a fastener mechanism as explained herein. The fastener mechanism may be moveably affixed at least at one end to one adjoining end of the third hoop and be moveable at another end to allow the fastener mechanism to be opened so as to allow the fastener mechanism to be inserted deeper into or through the ear piercing and afterwards be closed so as to provide for a firm attachment.

In the earring assembly disclosed in FIG. 2, the adjoining ends 67, 69 may be provided with a fastener mechanism 68 moveably affixed at each of the adjoining ends of the third hoop 62 to allow the fastener mechanism 68 to be opened so as to allow the fastener mechanism 68 to be inserted deeper into or through the ear piercing and afterwards be closed so as to provide for a firm attachment.

In the earring assembly disclosed in FIG. 2, the fastener mechanism 68 may include a small piece of material or wire. Fastener mechanisms for use with earrings are well known in the art and a matter of design choice.

FIG. 2A discloses a fourth assembled earring configuration for the earring assembly of FIG. 1. In the fourth assembled configuration of the earring assembly, each adjoining end 67, 69 of the third hoop 60 may be configurable when moved apart for insertion into opposing sides of the piercing in the earlobe or another external part of the ear of a user and when allowed to return to the normal position to be closely positioned with respect to each other so as to attachably hold the third hoop 60 to the opposing sides of the piercing in the earlobe or another external part of the ear of a user.

When being closely positioned following return to the normal position following insertion of the adjoining ends 67, 69 through the opposing sides of the piercing in the earlobe or another external part of the ear of a user, the adjoining ends hold the third earring 60 to the opposing sides of the piercing in the earlobe or another external part of the ear of a user.

The first earring 10 and the second earring 20 are not attached to the earlobe or another external part of the ear of the user in the fourth assembled configuration of the earring assembly.

Figure 3A:
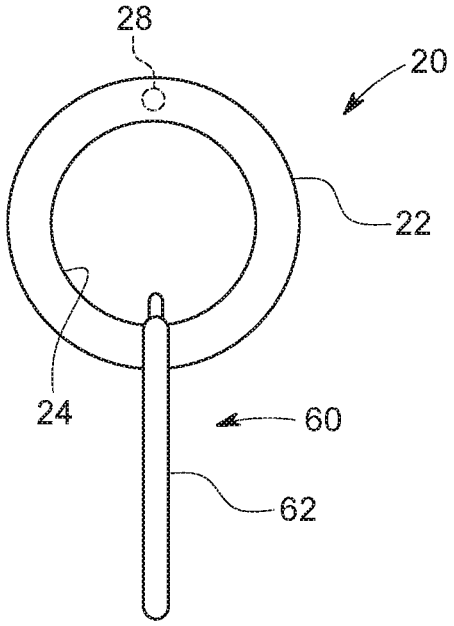
FIGS. 3A, 3B (collectively FIG. 3) discloses a fifth assembled configuration for an illustrative earring assembly according to this disclosure.
Figure 3B:
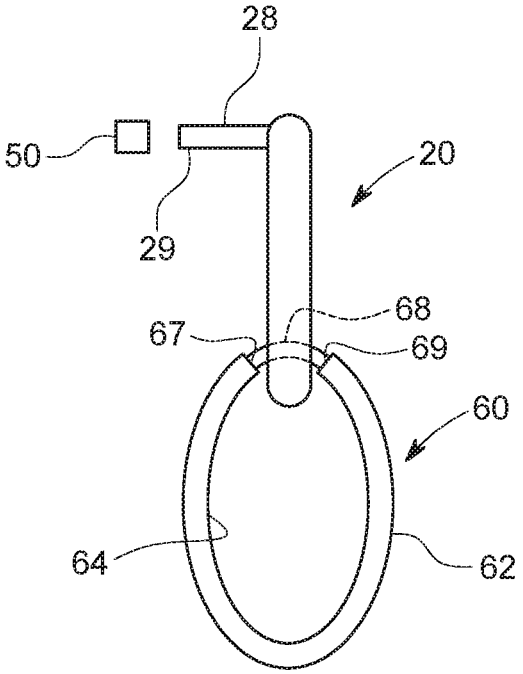

FIG. 3 discloses a fifth assembled configuration for the illustrative earring assembly of FIG. 1. In FIG. 3, FIG. 3A depicts a front view of second ring 22 and the FIG. 3B depicts the side view associated with the front view. The earring assembly includes a first earring, a second earring, and a post holder as previously explained. The earring assembly of FIG. 3 further includes a third earring 60 including a third hoop 62 of predetermined diameter and having a predetermined thickness and defining a third opening 64. The third hoop 62 is formed in the shape of a closed letter "C" with the ends of the closed letter "C" adjoining each other to create the appearance of a ring. The adjoining ends of the third hoop 62 are openable up with respect to each other when moved apart and are closely positioned with respect to each other when in a normal position. Each adjoining end of the third hoop 62 may be configurable when moved apart for insertion into opposing sides of the piercing in the earlobe or another external part of the ear of a user.

In the fifth assembled configuration of the earring assembly of this disclosure, each adjoining end 67, 69 of the third hoop 62 may be configurable when moved apart for insertion through the opening 24 defined by the second ring 20 and when allowed to return to the normal position to be closely positionable with respect to each other so as to attachably hold the third hoop 62 to the second hoop 22 when the second earring 20 is held to the earlobe or another external part of the ear of the user by the placement of the first post holder 50 on the end 29 of the first post 28 of the second hoop 22 after being threaded through the piercing in the earlobe or another external part of the ear of a user.

When being closely positioned following return to the normal position following insertion of the adjoining ends through the opening 24 defined by the second ring 20, the adjoining ends 67, 69 holds the third ring 60 to the second earring 20.

The first earring 10 is not attached to the earlobe or another external part of the ear of the user in the fifth assembled configuration of the earring assembly.

Figure 4A:
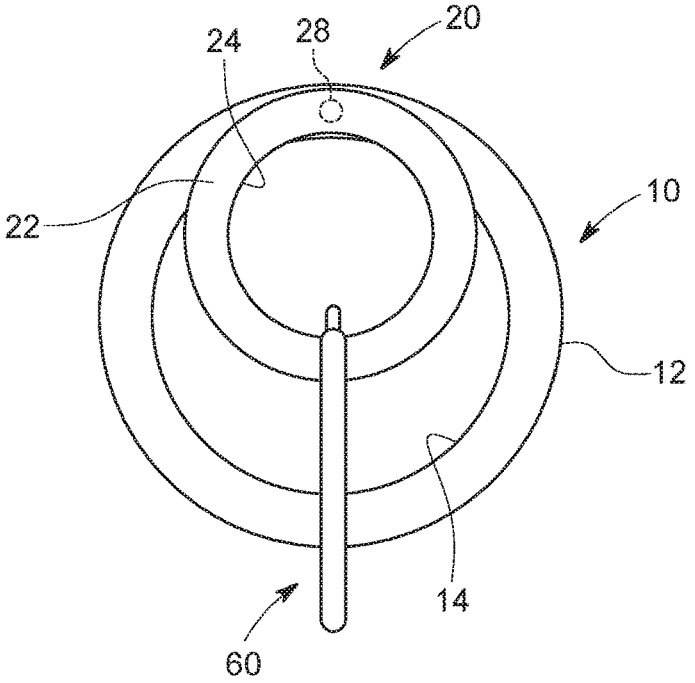
FIGS. 4A, 4B (collectively FIG. 4) discloses a sixth assembled configuration for an illustrative earring assembly according to this disclosure.
Figure 4B:
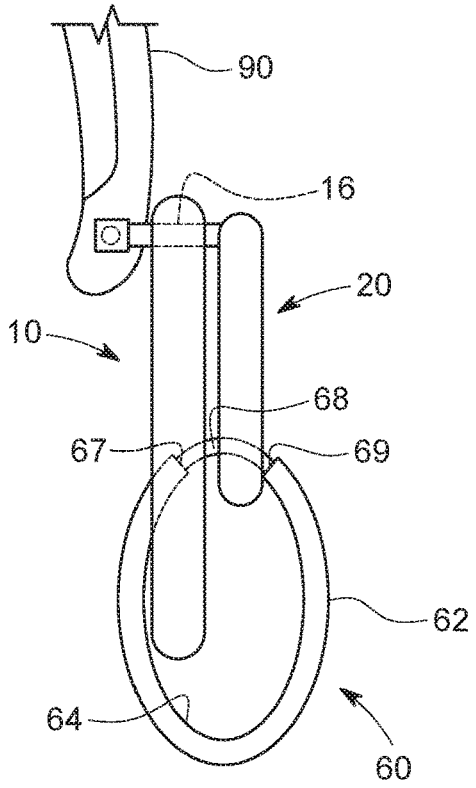

FIG. 4 discloses a sixth assembled configuration for the illustrative earring assembly of FIG. 1. In FIG. 4, FIG. 4A depicts a front view and FIG. 4B the side view associated with the front view. The earring assembly includes a first earring, a second earring, and a post holder as previously explained. The earring assembly of FIG. 4 further includes a third earring 60 including a third hoop 62 of predetermined diameter and having a predetermined thickness and defining a third opening 64. The third hoop 62 may be formed in the shape of a closed letter "C" with the ends of the closed letter "C" adjoining each other to create the appearance of a ring. The adjoining ends 67, 69 of the third hoop 62 may be openable up with respect to each other when moved apart and being closely positioned with respect to each other when in a normal position. Each adjoining end 67, 69 of the third hoop may be configurable when moved apart for insertion into opposing sides of the piercing in the earlobe or another external part of the ear of a user.

In the sixth assembled configuration of the earring assembly of this disclosure, each adjoining end 67, 69 of the third hoop 62 may be configurable when moved apart for insertion through the opening 14 defined by the first earring 10 and the opening 24 defined by the second earring 20 and when allowed to return to the normal position to be closely positioned with respect to each other so as to attachably hold the third hoop 62 to the first hoop 12 and the second hoop 22 when the first earring 10 and the second earring 20 are held to the earlobe or another external part of the ear of the user by the first post holder.

When being closely positioned following return to the normal position following insertion of the adjoining ends 67, 69 through the opening 14 defined by the first earring 10 and the second earring 20, the adjoining ends 67, 69 hold the third earring 60 to the first earring 10 and the second earring 20. In this assembly, the post 28 of the second hoop 22 extends through channel 16 in the first earring 10 and a piercing in the earlobe or other external part of the ear of the user. The second earring 20 and the first earring 10 (and the third earring 60 connected thereto) are held to the earlobe or another external part of the ear of the user by the placement of the first post holder 50 on the end of the first post 28 of the second hoop 22 after being threaded through the piercing in the earlobe or another external part of the ear of a user.

Figure 5A:
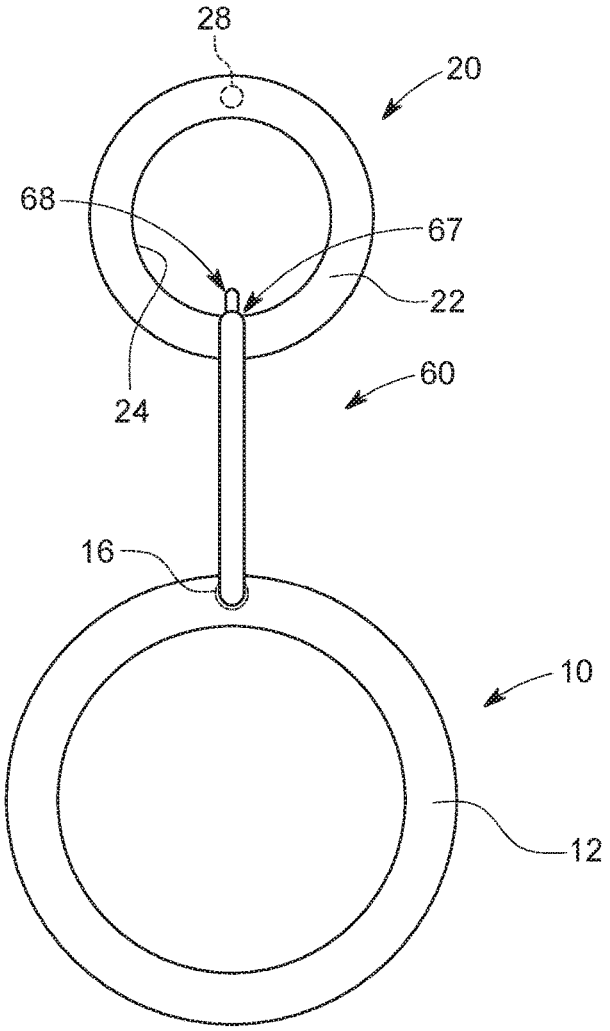
FIGS. 5A, 5B (collectively FIG. 5) discloses a seventh assembled configuration for an illustrative earring assembly according to this disclosure.
Figure 5B:
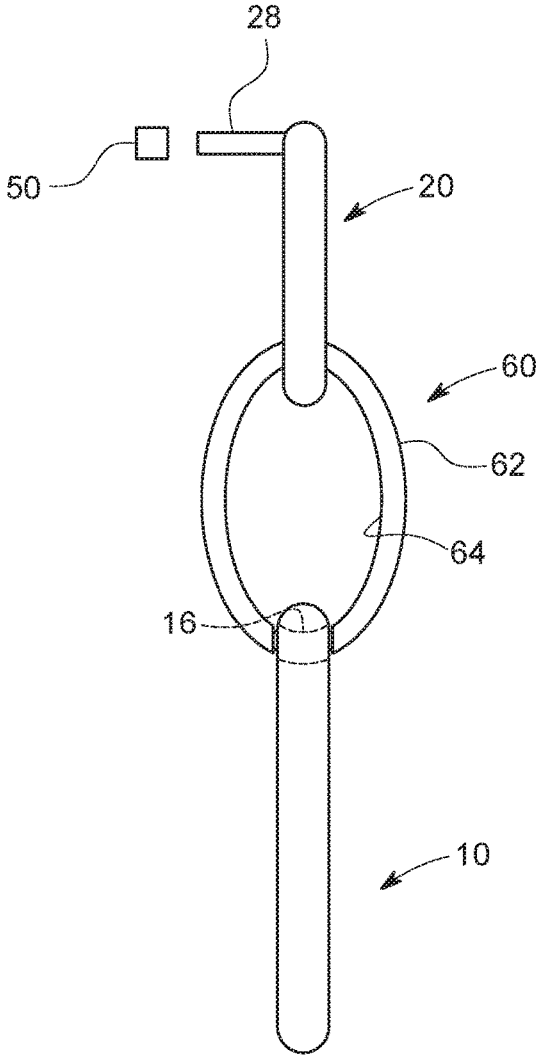

FIG. 5 discloses a seventh assembled configuration for the illustrative earring assembly of FIG. 1. In FIG. 5, FIG. 5A depicts a front view and FIG. 5B the side view associated with the front view. The earring assembly includes a first earring 10, a second earring 20, and a post holder 50 as previously explained. The earring assembly of FIG. 5 further includes a third earring 60 comprising a third hoop 62 of predetermined diameter and having a predetermined thickness and defining a third opening 64. The predetermined thickness of the third hoop 62 is smaller than the predetermined diameter of the first channel 16 of the first hoop 12. The predetermined thickness of the third hoop 62 may be configured to extend through the first channel 16 of the first hoop 12.

The third hoop 62 may be formed in the shape of a closed letter "C" with the ends of the closed letter "C" adjoining each other to create the appearance of a ring, the adjoining ends of the third hoop 62 being openable up with respect to each other when moved apart and closely positionable with respect to each other in a normal position, each adjoining end being configurable when moved apart for insertion into opposing sides of the piercing in the earlobe or another external part of the ear of a user.

In the seventh assembled configuration of this disclosure the predetermined thickness of the third hoop 62 extends through the first channel 16 of the first hoop 12 and through opening 24 in the second earring 20 so as to attachably hold the third hoop 62 to the first hoop 12 of earring 10 when the second earring 20 is held to the earlobe or another external part of the ear of the user by the placement of the first post holder 50 on the first post 28 of the second earring 20.

Each adjoining end 67, 69 of the third hoop 62 may be configurable when moved apart for insertion through the opening defined by the second hoop 22 and when allowed to return to the normal position to be closely positionable with respect to each other so as to attachably hold the third hoop 62 to the second hoop 22 when the second earring 20 is held to the earlobe or another external part of the ear of the user by the placement of the first post holder 50 on the first post 28 of the second hoop 22.

When being closely positioned following return to the normal position following insertion of the adjoining ends through the opening 24 defined by the second hoop 22, the hoop 62 holds the third earring 60 to the first earring 10 and the second earring.

Figure 6A:
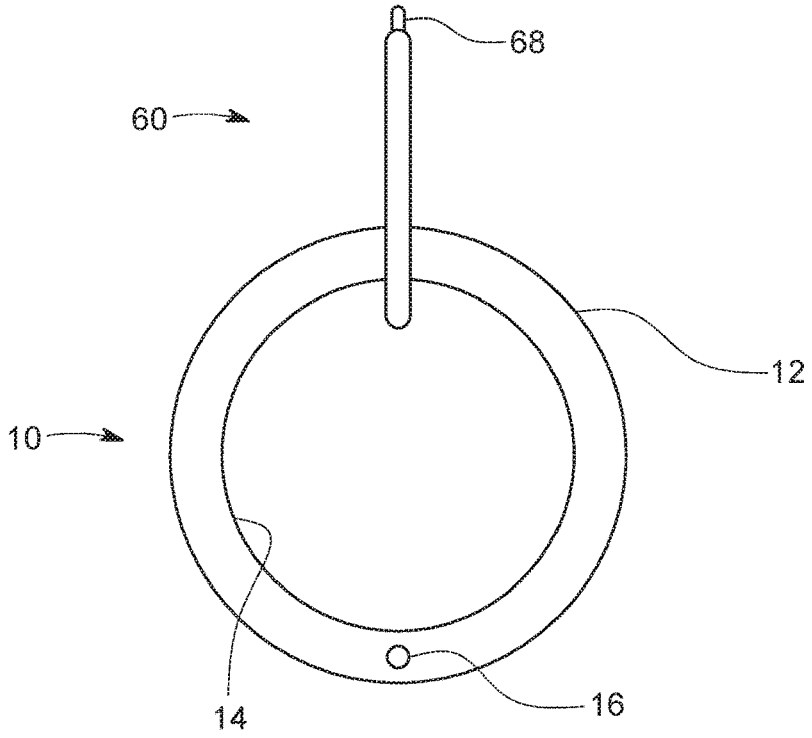
FIGS. 6A, 6B (collectively FIG. 1) discloses an eighth assembled configuration for an illustrative earring assembly according to this disclosure.
Figure 6B:
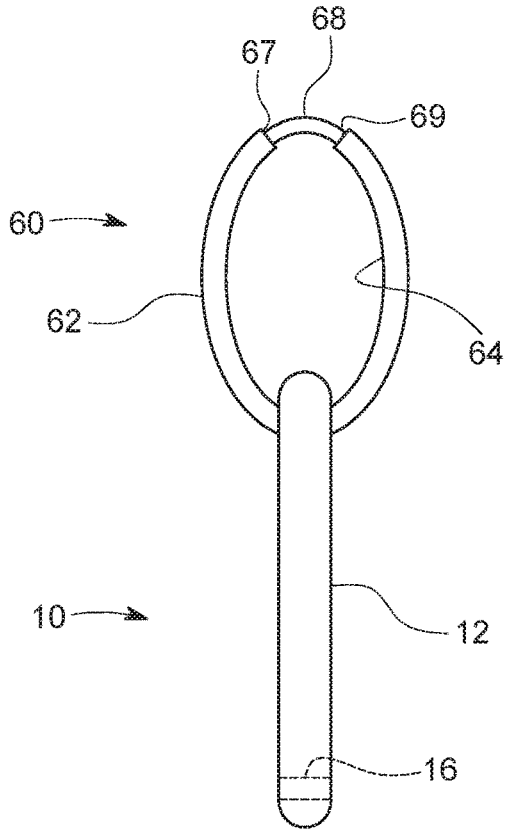

FIG. 6 discloses an eighth assembled configuration for the illustrative earring assembly of FIG. 1. In FIG. 6, FIG. 6A depicts a front view and FIG. 6B the side view associated with the front view. The earring assembly includes a first earring 10, a second earring 20, and a post holder 50 as previously explained. The earring assembly of FIG. 6 further includes a third earring 60 including a third hoop 62 of predetermined diameter and having a predetermined thickness and defining a third opening 64, the third hoop 62 being formed in the shape of a closed letter "C" with the ends 67, 69 of the closed letter "C" adjoining each other to create the appearance of a ring. The adjoining ends 67, 69 of the third hoop 62 may be openable up with respect to each other when moved apart and being closely positioned with respect to each other when in a normal position. Each adjoining end 67, 69 of the third hoop 62 may be configurable when moved apart for insertion into opposing sides of the piercing in the earlobe or another external part of the ear of a user.

Each adjoining end 67, 69 of the third hoop 62 may be configurable when moved apart for insertion through the opening 14 defined by the first earring 10 and when allowed to return to the normal position to be closely positionable with respect to each other so as to attachably hold the third hoop 62 to the first hoop 12.

Each adjoining end 67, 69 of the third hoop 62 may be configurable when moved apart for insertion into opposing sides of the piercing in the earlobe or another external part of the ear of a user and when allowed to return to the normal position to be closely positionable with respect to each other so as to attachably hold the third hoop 62 to the earlobe or another external part of the ear of a user.

The second earring 20 is not attached to the earlobe or another external part of the ear of the user in the eight assembled configuration.

Figure 7A:
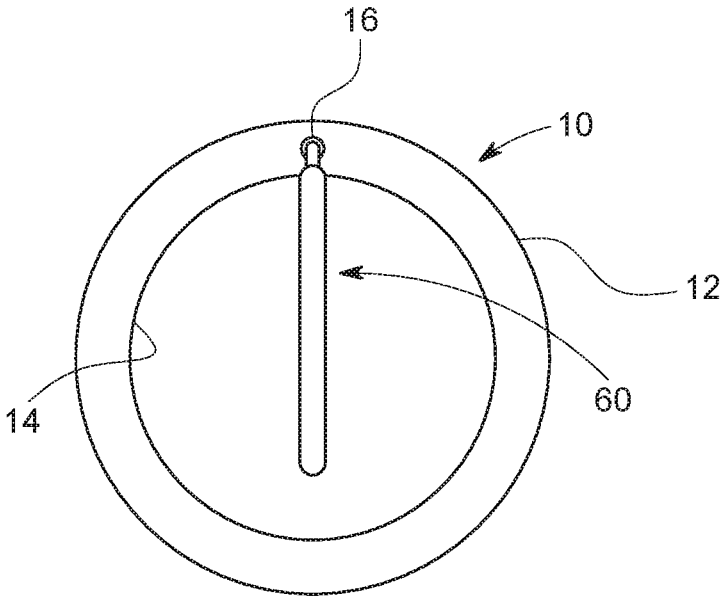
FIGS. 7A, 7B (collectively FIG. 7) discloses a ninth assembled configuration for an illustrative earring assembly according to this disclosure.
Figure 7B:
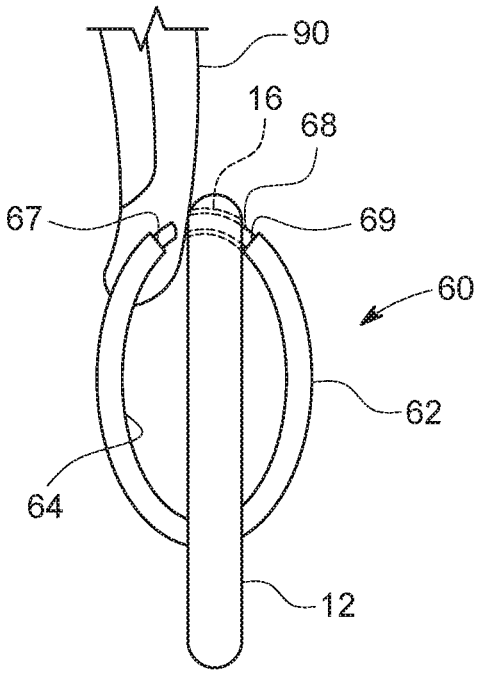

FIG. 7 discloses a ninth assembled configuration for the illustrative earring assembly of FIG. 1. In FIG. 7, FIG. 7A depicts front views and FIG. 7B the side view associated with the front views. The earring assembly includes a first earring 10 and a second earring 60 as previously explained. In the earring assembly of FIG. 7, the first hoop 10 defines a first channel 16 of a predetermined diameter through a portion of the side of the first hoop. The first channel 16 extends through the predetermined thickness of the first hoop 10. The second earring 60 includes a second hoop 62 of predetermined diameter and having a predetermined thickness and defining an opening 64. The second hoop 62 is formed in the shape of a closed letter "C" with the ends of the closed letter "C" adjoining each other to create the appearance of a ring. The adjoining ends of the second hoop 62 are openable up with respect to each other when moved apart and are closely positioned with respect to each other when in a normal position. Each adjoining end of the second hoop 62 may be configurable when moved apart for insertion into opposing sides of the piercing in the earlobe or another external part of the ear of a user In the ninth assembled configuration of the earring assembly, each adjoining end of the second hoop 62 being configurable when moved apart for insertion through the opening defined by the first hoop 14 and for threading through the piercing in the earlobe or another external part of the ear of a user.

On allowing each adjoining end of the second hoop to return to the normal position to be closely positionable with respect to each other, the second hoop 62 attachably holds the second earring to the first earring and to the earlobe or another external part of the ear of the user.

Figure 8A:
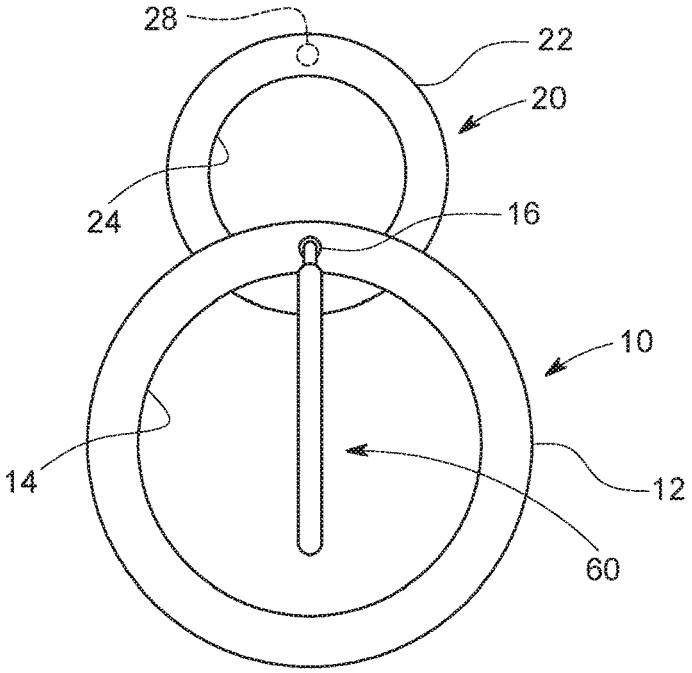
FIGS. 8A, 8B (collectively FIG. 8) discloses a tenth assembled configuration for an illustrative earring assembly according to this disclosure.
Figure 8B:
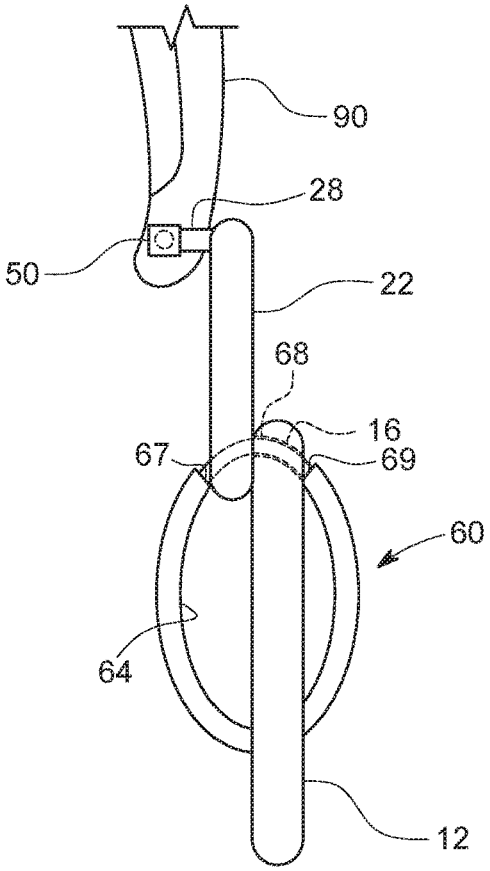

FIG. 8 discloses a tenth assembled configuration for the illustrative earring assembly of FIG. 1. In FIG. 8, FIG. 8A depicts front views and FIG. 8B the side view associated with the front view. The earring assembly includes a first earring 10, a second earring 20, and a post holder 50 as previously explained. The first hoop 10 defines a channel 16. The second hoop 22 of the earring assembly of FIG. 8 further includes a post 28 of a predetermined diameter and length. The post 28 extends from and away from a portion of the side of the second hoop 22. The post 28 may be configured to extend through the earlobe or another external part of the ear of the user.

The earring assembly further includes a third earring 60 including a third hoop 62 of predetermined diameter and having a predetermined thickness and defining a third opening 64. The third hoop 62 may be formed in the shape of a closed letter "C" with the ends of the closed letter "C" adjoining each other to create the appearance of a ring, the adjoining ends 67, 69 of the third hoop being openable up with respect to each other when moved apart and closely positioned with respect to each other in a normal position, each adjoining end 67, 69 being configurable when moved apart for insertion into opposing sides of the piercing in the earlobe or another external part of the ear of a user.

In the tenth assembled configuration each adjoining end of the third hoop 62 may be configurable when moved apart for insertion through both the channel 16 defined in first hoop 12 and the opening 24 defined by the second hoop 22 and when allowed to return to the normal position to be closely positionable with respect to each other so as to attachably hold the third hoop 62 and the first hoop 12 to the second hoop 22. Each adjoining end 67, 69 of the third hoop may be configurable when moved apart to allow threading of the predetermined thickness of the third hoop 62 through the first channel 16 of the first hoop 12 and the opening 24 defined by the second hoop 22 so as to attachably hold the third hoop 62 and the first loop 12 to the second hoop 22. The post 18 of the second earring 20 may be configured to be threaded through the piercing in the earlobe or another external part of the ear of a user and the post holder 50 being configured to be placed on the end of the post 18 in order to hold the first earring 20 and the second earring 10 and the third earring 60 to the earlobe or another external part of the ear of the user.

Figure 9A:
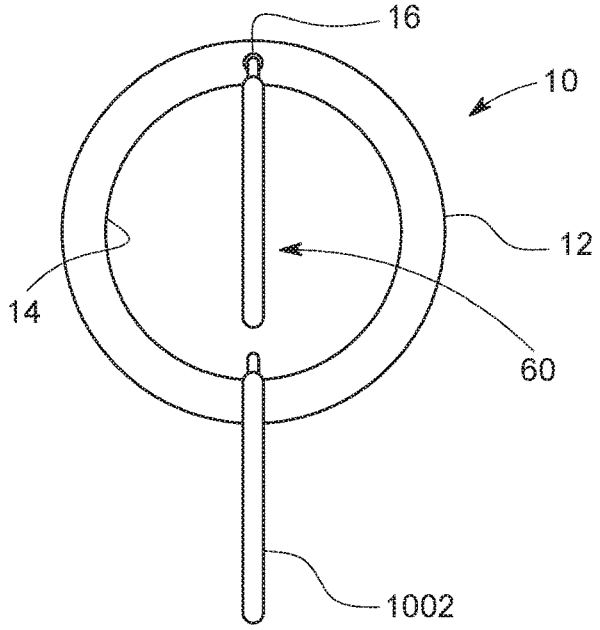
FIGS. 9A, 9B (collectively FIG. 9) discloses an eleventh assembled configuration for an illustrative earring assembly according to this disclosure.
Figure 9B:
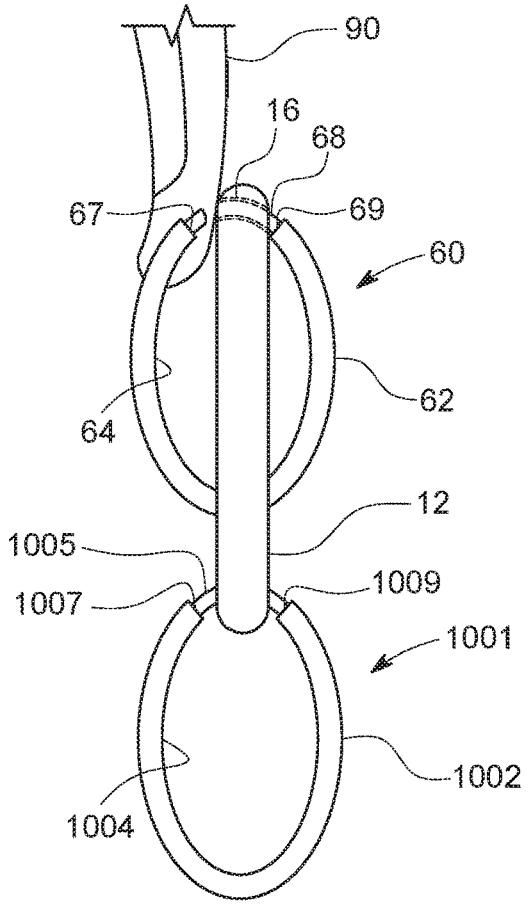

FIG. 9 discloses an eleventh assembled configuration for the illustrative earring assembly of FIG. 1. In FIG. 9, FIG. 9A depicts front view and FIG. 9B the side view associated with the front view. The earring assembly includes a first earring 60, a second earring 10, and a third earring 1001. The first earring 60 includes a first hoop 62 of predetermined diameter and having a predetermined thickness and defining a first opening 64. The predetermined thickness of the first hoop 62 may be configured to extend through the earlobe or another external part of the ear of the user. The first hoop 62 may be formed in the shape of a closed letter "C" with the ends of the closed letter "C" adjoining each other to create the appearance of a ring, the adjoining ends 67, 69 of the first hoop 62 being openable up with respect to each other when moved apart and closely positioned with respect to each other in a normal position, each adjoining end 67, 69 being configurable when moved apart for insertion into opposing sides of the piercing in the earlobe or another external part of the ear of a user.

The second earring 10 includes a hoop 12 defining a second opening 14 and a channel 16. The third earring 1001 includes a third hoop 1002 of predetermined diameter and having a predetermined thickness and defining a third opening 1004. The third hoop 22 may be formed in the shape of a closed letter "C" with the ends of the closed letter "C" adjoining each other to create the appearance of a ring, the adjoining ends 1007, 1009 of the third hoop 62 being openable up with respect to each other when moved apart and closely positioned with respect to each other in a normal position, each adjoining end 1007, 1009 being configurable when moved apart for insertion into opposing sides of the piercing in the earlobe or another external part of the ear of a user.

In the eleventh assembled configuration each adjoining end 1007, 1009 of the third hoop 1002 may be configurable when moved apart to allow threading of the predetermined thickness of the third hoop 1002 through the opening 14 of the second hoop 12 so as to attachably hold the third hoop 1002 to the second hoop 12.

Further each adjoining end of the first hoop 62 may be configurable when moved apart to allow threading of the predetermined thickness of the first hoop 62 through the opening 16 of the second hoop 12 and the piercing in the earlobe or another external part of the ear of a user so as to attachably hold the first loop 62 and both the second hoop 12 and the third hoop 1002 attachably connected to the second hoop 12 to the piercing in the earlobe or another external part of the ear of a user.

Figure 10A:
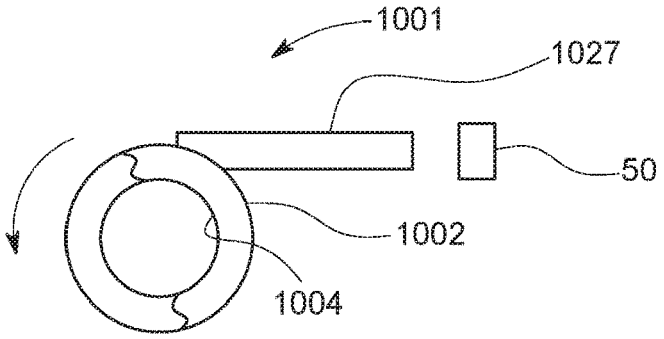
FIGS. 10A, 10B, and 10C (collectively FIG. 10) discloses twelfth assembled configuration for an illustrative earring assembly according to this disclosure.
Figure 10B:
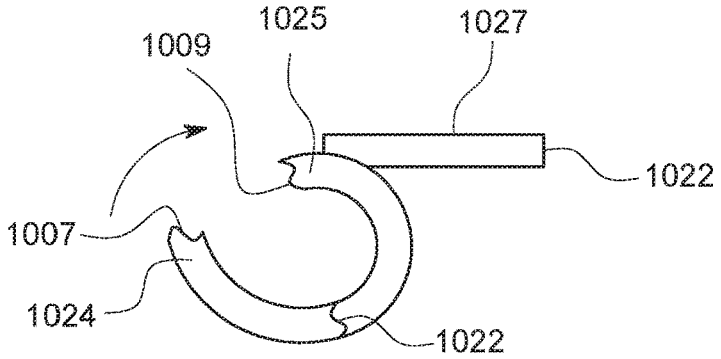
Figure 10C:
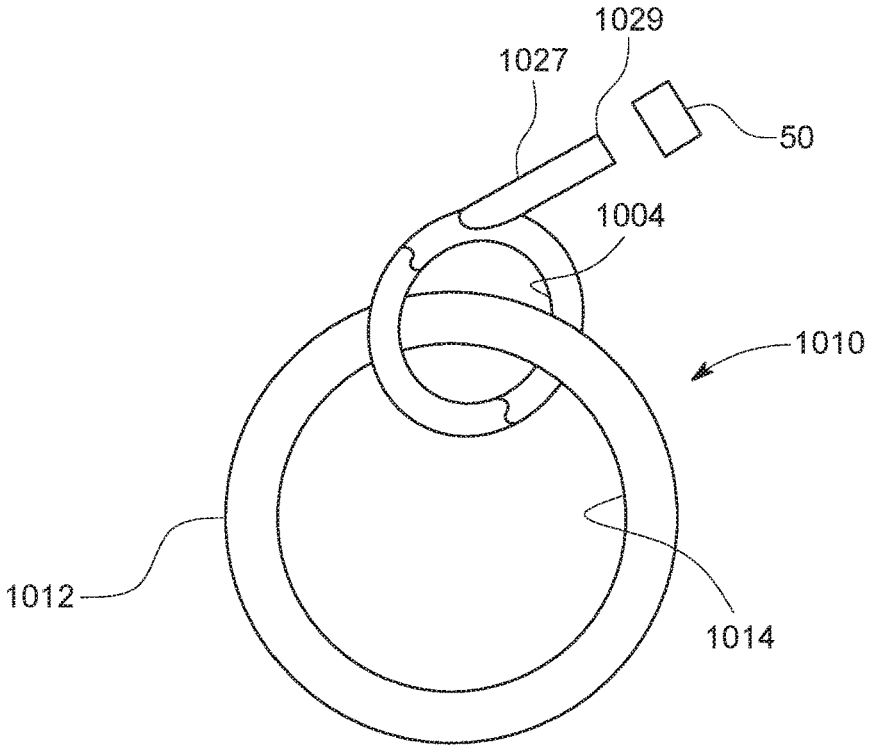

FIG. 10 discloses an alternative assembled configuration for the illustrative earring assembly of this disclosure. The earring assembly comprises a first earring 1001, a second earring 1010, and a post holder 50.

The first earring 1001 includes a first hoop 1002 defining a first opening 1004. The first hoop 1002 further includes a movable elbow 1022 and a mating connector 1007, 1009. The movable elbow 1022 is configured to enlarge the open area of the first opening 1004 in order to receive the second earring 1010. The mating connector 1007, 1009 are configured to mate and secure end 1024 of the first opening 1004 to opposing end 1025 of the first hoop 1002. The first earring further includes a first post 1029 of a predetermined diameter and a length longer than the predetermined thickness of the piercing in the earlobe or another external part of the ear of a user, the first post extending from and away from a portion of a side of the first hoop, the predetermined diameter of the first post being smaller than the predetermined diameter of an opening in the earlobe or another external part of the ear of the user.

The second earring may be a hoop 1012 defining an opening 1014. Hoop 1012 is depicted to be a continuous hoop without any discontinuity that would allow the hoop to be opened up so as to be threadable through other rings, the earlobe or another external part of the ear of the user, or other things. Alternatively, hoop 1012 may be provided with an openable section such as the earring 60 depicted in FIG. 3.

The post holder 50 is received over an end 1029 of the first post 1029 that has been threaded through the earlobe or another external part of the ear of the user in order to secure the first ring, and the second ring connected thereto to the ear or another external part of the ear of the user.

In a twelfth assembled configuration, the first post 1027 of the first hoop 1002 is configured to be threaded through the opening in the earlobe or another external part of the ear of the user, and the first post holder 50 is configured to be placed on the end of the threaded first post of the second hoop in order to hold both the first earring to the earlobe or another external part of the ear of the user and the second earring 1010 through which hoop 1002 of the first earring 1001 is threaded.

The individual components that may be useable in the modular earring assembly of this disclosure include earrings, hoops, post holder, adjacent ends, fastener mechanism, and so on are a matter of design choice as to form, function and materials or combinations of materials used.

Each of FIGS. 1-9 illustrate earing assemblies according to this disclosure for one ear. It will be appreciated from this disclosure that earing assemblies from one ear may be combined with earring assemblies from the other ear to form yet further combinations of earring assemblies in accordance with disclosure. For example, if a user has two sets of the FIG. 1 disclosed embodiments, one for each ear, the user may wear the assembly depicted in FIG. 1C in one ear while wearing only the earring 10 in the other ear. Alternatively, the two sets of the user may be the earring assembly depicted in FIG. 1 and the earring assembly depicted in FIG. 3. Because each assembly includes a different assembly of rings, the user may wear the earring assembly depicted in FIG. 1 in one ear and earring 60 depicted in FIG. 3B in the other ear. It will be appreciated that any number of assemblies may be used by the user and the number of assemblies and the components of each assemblies available to the user allow the user to mix and match components and assemblies to provide an even wider array of earring presentations to allow for a wider range of uses. As yet another example, the user may employ only one earring assembly, such as the one depicted in FIG. 3 and use earring 20 in one ear, earring 60 in the other ear; or alternatively wear the assembly depicted in FIG. 3 in one ear with nothing worn in the other ear.

It will be appreciated from this disclosure that earrings with posts such as post 28 in FIG. 3B may be replaced with earrings including a mechanism 68 connector or with earrings of the kind depicted in FIG. 10, or with earrings that are connected to the earlobe or other piercings of the earlobe in these and other embodiments of this disclosure.

While channel 16 depicted in FIG. 1A is depicted as a bore through the hoop 12, it will be appreciated that there are other ways to provide a channel to the hoop without using a boring in the hoop. For example, the section of the hoop having the bore may be replaced with a mechanism 68 as depicted in FIG. 3B and a second loop. The first loop with mechanism 68 may be adhered to the second loop mechanically, adhesively, or in other ways, thereby forming a FIG. 8 shape. The mechanism when opened may secure the FIG. 8 shape to hoop 12. The other opening of the FIG. 8 may then serve as the channel 16 through which an earring may be threaded to secure the earring to hoop 12 as explained in this disclosure. While this disclosure has been described in connection with specific embodiments, it is evident that numerous alternatives, modifications, and variations will be apparent to those skilled in the art within the spirit and scope of the above disclosure.

What is claimed is:

1. An earring assembly comprising:

a first hoop including an outside diameter and an inside diameter, the difference between the outside diameter and the inside diameter defining a predetermined first hoop thickness area, the first hoop including a first opening of a predetermined diameter extending along a portion of the predetermined first hoop thickness area of the first hoop and through the first hoop, the first hoop further including a second opening defined by the inside diameter of the first hoop; and a second hoop including an outside diameter and an inside diameter, the difference between the outside diameter and the inside diameter defining a predetermined second hoop thickness area the second hoop including a post, the post extending away from a section of the predetermined second hoop thickness area and having a diameter smaller than the predetermined diameter of the first opening of the first hoop, the second hoop further including a first opening defined by the inside diameter of the second hoop; and a post holder, the post holder configured to be placed over on an end of the post in order to secure the post to the post holder;

wherein, in an assembled configuration, the post of the second hoop is threaded through both the first opening of the first hoop and a piercing in an earlobe or another external part of an ear of a user; and wherein the post holder is placed on the end of the post to secure the predetermined second hoop thickness area against the predetermined first hoop thickness area so as to secure both the second hoop and the first hoop to an earlobe or another external part of an ear of a user.

2. The earring assembly of claim 1, wherein the second opening of the first hoop is larger than the first opening of the second hoop.

3. The earring assembly of claim 1, wherein the second opening of the first hoop is smaller than the first opening of the second hoop.

4. The earring assembly of claim 1, wherein the post holder is a removable friction back.

5. The earring assembly of claim 1, wherein the post holder is a clasp.

6. The earring assembly of claim 1 further comprising:

a third hoop including an outside diameter and an inside diameter, the difference between the outside diameter and the inside diameter defining a predetermined third hoop thickness area, the third hoop further including a first opening defined by the inside diameter of the third hoop, the third hoop including a fastener mechanism along one section of the third hoop that allows the third hoop to be opened and closed;

wherein the fastener mechanism of the third hoop is opened to allow the third hoop to be slipped inside the first opening of the second hoop, and closed to secure the third hoop to the second hoop.

7. The earring assembly of claim 1 further comprising:

a third hoop including an outside diameter and an inside diameter, the difference between the outside diameter and the inside diameter defining a predetermined third hoop thickness area, the third hoop further including a first opening defined by the inside diameter of the third hoop, the third hoop including a fastener mechanism along one section of the third hoop that allows the third hoop to be opened and closed;

wherein the fastener mechanism of the third hoop is opened to allow the third hoop to be slipped inside the first opening of the second hoop and the second opening of the first hoop, and closed to secure the third hoop to the second hoop and the first hoop.

8. An earring assembly comprising:

a first hoop including an outside diameter and an inside diameter, the difference between the outside diameter and the inside diameter defining a predetermined first hoop thickness area, the first hoop including a first opening of a predetermined diameter extending along a portion of the predetermined first hoop thickness area of the first hoop and through the first hoop, the first hoop further including a second opening defined by the inside diameter of the first hoop; and a second hoop including an outside diameter and an inside diameter, the difference between the outside diameter and the inside diameter the inside diameter defining a predetermined second hoop thickness area, the second hoop including a post, the post extending away from a section of the predetermined second hoop thickness area and having a diameter smaller than the predetermined diameter of the first opening of the first hoop, the second hoop further including a first opening defined by the inside diameter of the second hoop;

a third hoop including an outside diameter and an inside diameter, the difference between the outside diameter and the inside diameter of the third hoop defining a predetermined third hoop thickness area, the third hoop further including a first opening defined by the inside diameter of the third hoop, the third hoop including a fastener mechanism along one section of the third hoop that allows the third hoop to be opened and closed;

a post holder, the post holder configured to be placed over on an end of the post in order to secure the post to the post holder;

wherein, in an assembled configuration, the fastener mechanism of the third hoop is opened to allow the third hoop to be slipped through the second opening of the first hoop and the first opening of the second hoop and closed to secure the first hoop to the third hoop and the third hoop to the second hoop;

wherein, the post of the second hoop is threaded through a piercing in an earlobe or another external part of an ear of a user; and wherein the post holder is placed on the end of the post to secure the second hoop, and the third hoop and the first hoop secured to the second hoop, to an earlobe or another external part of an ear of a user.

9. An earring assembly comprising:

a first hoop including an outside diameter and an inside diameter, the difference between the outside diameter and the inside diameter defining a predetermined first hoop thickness area, the first hoop including a first opening of a predetermined diameter extending along a portion of the predetermined first hoop thickness area of the first hoop and through the first hoop, the first hoop further including a second opening defined by the inside diameter of the first hoop; and a third hoop including an outside diameter and an inside diameter, the difference between the outside diameter and the inside diameter defining a predetermined third hoop thickness area, the third hoop further including a first opening defined by the inside diameter of the third hoop, the third hoop including a fastener mechanism along one section of the third hoop that allows the third hoop to be opened and closed;

wherein, in an assembled configuration, the fastener mechanism of the third hoop is opened to allow the third hoop to be slipped through the second opening of the first hoop;

wherein, the fastener mechanism of the third hoop is threaded through a piercing in an earlobe or another external part of an ear of a user to secure the third hoop, and the first hoop held by the third hoop, to an earlobe or another external part of an ear of a user.

10. The earring assembly of claim 9, wherein, in the assembled configuration, the fastener mechanism of the third hoop holds the second opening of the first hoop near an earlobe or another external part of an ear of a user.

11. The earring assembly of claim 10, wherein the third hoop defining a first third hoop, the earing assembly further comprising:

a second third hoop including an outside diameter and an inside diameter, the difference between the outside diameter and the inside diameter of the second third hoop defining a predetermined second third hoop thickness area, the second third hoop further including a first opening defined by the inside diameter of the second third hoop, the second third hoop including a fastener mechanism along one section of the second third hoop that allows the second third hoop to be opened and closed; and wherein, in the assembled configuration, the fastener mechanism of the second third hoop is opened to allow the second third hoop to be slipped through the first opening of the first hoop; and wherein, the second third hoop is held to the first hoop when the fastener mechanism of the first third hoop is threaded through a piercing in an earlobe or another external part of an ear of a user to secure the first third hoop, and the first hoop and the second third hoop held by the first third hoop, to an earlobe or another external part of an ear of a user.

12. An earring assembly comprising:

first hoop including an a first hoop including an outside diameter and an inside diameter, the difference between the outside diameter and the inside diameter defining a predetermined first hoop thickness area, the first hoop including a first opening of a predetermined diameter extending along a portion of the predetermined first hoop thickness area of the first hoop and through the first hoop, the first hoop further including a second opening defined by the inside diameter of the first hoop; and a second hoop including an outside diameter and an inside diameter, the difference between the outside diameter and the inside diameter of the second hoop defining a predetermined second hoop thickness area, the second hoop including a post, the post extending away from a section of the predetermined second hoop thickness area and having a diameter smaller than the predetermined diameter of the first opening of the first hoop, the second hoop further including a first opening defined by the inside diameter of the second hoop;

a third hoop including an outside diameter and an inside diameter, the difference between the outside diameter and the inside diameter of the third hoop defining a predetermined third hoop thickness area, the third hoop further including a first opening defined by the inside diameter of the third hoop, the third hoop including a fastener mechanism along one section of the third hoop that allows the third hoop to be opened and closed;

a post holder, the post holder configured to be placed over on an end of the post in order to secure the post to the post holder;

wherein, in an assembled configuration, the fastener mechanism of the third hoop is opened to allow the third hoop to be slipped through the first opening of the first hoop and the first opening of the second hoop and closed to secure the first hoop to the third hoop and the third hoop to the second hoop;

wherein, the post of the second hoop is threaded through a piercing in an earlobe or another external part of an ear of a user; and, wherein the post holder is placed on the end of the post to secure the second hoop, and the third hoop and the first hoop secured to the second hoop, to an earlobe or another external part of an ear of a user.

* * * * *